US011837210B1

(12) United States Patent
Su et al.

(10) Patent No.: US 11,837,210 B1
(45) Date of Patent: Dec. 5, 2023

(54) POROUS COMPOSITE SOUND-ABSORBING MATERIAL, METHOD FOR PREPARING THE SAME

(71) Applicant: AAC Technologies (Nanjing) Co., Ltd., Nanjing (CN)

(72) Inventors: Yuanwei Su, Shenzhen (CN); Hezhi Wang, Shenzhen (CN); Changliang Wang, Shenzhen (CN)

(73) Assignee: AAC Technologies (Nanjing) Co., Ltd., Nanjing (CN)

( * ) Notice: Subject to any disclaimer, the term of this patent is extended or adjusted under 35 U.S.C. 154(b) by 0 days.

(21) Appl. No.: 18/094,996

(22) Filed: Jan. 10, 2023

Related U.S. Application Data

(63) Continuation of application No. PCT/CN2022/119949, filed on Sep. 20, 2022.

(30) Foreign Application Priority Data

Sep. 2, 2022 (CN) ..... 202211070755.X

(51) Int. Cl.
*G10K 11/165* (2006.01)
*G10K 11/36* (2006.01)

(52) U.S. Cl.
CPC ..... *G10K 11/165* (2013.01); *G10K 11/36* (2013.01)

(58) Field of Classification Search
CPC ..... G10K 11/165; G10K 11/36
See application file for complete search history.

(56) References Cited

U.S. PATENT DOCUMENTS

2008/0135327 A1* 6/2008 Matsumura ..... E01F 8/0011 181/294

* cited by examiner

*Primary Examiner* — C Melissa Koslow
(74) *Attorney, Agent, or Firm* — W&G Law Group

(57) ABSTRACT

A porous composite sound-absorbing material and a method for preparing the same are provided. The porous composite sound-absorbing material includes activated carbon cotton felt, zeolite particles, and an adhesive. The activated carbon cotton felt can bond the zeolite particles to fiber surfaces thereof by means of the adhesive, so that the zeolite particles are evenly dispersed and fixed and achieve optimal sound absorption performance. Meanwhile, a large number of micro-pore structures on surfaces thereof can act synergistically with the zeolite particles, so that the porous composite sound-absorbing material has significantly better sound absorption performance than the two and has extremely high cost performance. During the preparation process, the activated carbon cotton felt after treatments, is successfully compounded with the zeolite particles with more excellent sound absorption performance, so that the sound absorption performance is significantly improved and the cost performance is extremely high.

11 Claims, 3 Drawing Sheets

POROUS COMPOSITE SOUND-ABSORBING MATERIAL, METHOD FOR PREPARING THE SAME

TECHNICAL FIELD

The present disclosure relates to the field of composite materials, and in particular, the present disclosure relates to a porous composite sound-absorbing material and a method for preparing the porous composite sound-absorbing material.

BACKGROUND

With the rapid development of consumer electronics industry and the rapid improvement of people's living standards, miniaturization and flattening of consumer electronic products are increasingly favored by consumers. Meanwhile, people have higher and higher requirements for sound, desiring to obtain better sound quality in an effective space, which has more and more strict requirements for speakers.

Generally, the smaller a volume of a rear cavity of a speaker, the worse acoustic response of a low frequency band, which leads to worse acoustic performance such as the sound quality. Therefore, the rear cavity of the speaker has to be enlarged to improve low-frequency response thereof.

In order to enlarge the rear cavity of the speaker, those skilled in the art propose a variety of methods as follows.

1. The rear cavity is filled with gas with better sound compliance than air, such as carbon dioxide. This method has a problem of poor long-term reliability due to high difficulty of sealing the cavity.
2. The rear cavity is filled with sound-absorbing cotton such as melamine foam, polyurethane foam, and polyester sound-absorbing cotton. However, such materials have relatively large pore sizes, and have limited space for improvement of the sound quality.
3. The rear cavity is filled with porous materials such as activated carbon, zeolite, and silica, which increases a volume of a dummy rear cavity and improves sound compliance of gas in the rear cavity. Such materials have a significantly improved effect due to a large number of micro-pore structures, but have two problems. Firstly, the materials with excellent sound absorption performance are mostly granular, which have limited use for a speaker device with a complex rear cavity. Secondly, improvement in the effect of natural zeolite is limited. Although the effect can be significantly improved by secondary molding, costs are relatively high.

In view of the limitations of the above methods, technicians have also made many attempts, such as adding zeolite or activated carbon particles to the sound-absorbing cotton or sound-absorbing fiber structural materials. This method not only improves the performance, but also is easy to use due to blocky materials. However, this method has obvious limitations. All framework materials used are conventional macro-pore structure materials, which play more roles in dispersing, fixing, and supporting sound-absorbing particles, but make limited contributions to sound absorption performance of porous composite sound-absorbing materials. To achieve better performance, it is often the case that a large number of sound-absorbing particles such as zeolite or activated carbon particles are added, which leads to a significant increase in the costs and a low upper limit of final sound absorption performance of the materials.

Therefore, a new method that can enlarge the rear cavity of the speaker is in urgent need in the art.

SUMMARY

With respect to the deficiency of the related art, targeted improvement is made in the present disclosure. In the present disclosure, conventional framework materials (framework materials without a large number of micro-pores, such as sound-absorbing foam and sound-absorbing fibers) are replaced with activated carbon cotton felt including a large number of micro-pore structures, which can fix zeolite particles like ordinary framework materials, have good dispersibility, and enable sound absorption performance of the zeolite particles to be optimal. Meanwhile, a large number of micro-pore structures on surfaces of activated carbon can coordinate with the zeolite particles, so that the porous composite sound-absorbing material finally has significantly better sound absorption performance than the two, and has relatively low costs and extremely high cost performance at the same time.

According to a first aspect of the present disclosure, the present disclosure provides a porous composite sound-absorbing material, comprising activated carbon cotton felt, zeolite particles, and an adhesive. The activated carbon cotton felt serves as a framework material, and the zeolite particles are bonded to a fiber surface of the activated carbon cotton felt by means of the adhesive. The zeolite particles are evenly dispersed and fixed and achieve optimal sound absorption performance. Meanwhile, a large number of micro-pore structures exist on the fiber surface of the activated carbon cotton felt and can act synergistically with the zeolite particles, so that the porous composite sound-absorbing material has significantly better sound absorption performance than the two.

As an improvement, the activated carbon cotton felt used in the present disclosure are porous, with a specific surface area generally ranging from 100 $m^2/g$ to 1800 $m^2/g$. The activated carbon cotton felt applicable to the present disclosure has abundant structures of macro-pores between the activated carbon fibers, and the activated carbon fibers of the activated carbon cotton felt have a large number of micro-pores on surfaces. Macro-pores with pore sizes ranging from 1 μm to 1000 μm exist among activated carbon fibers of the activated carbon cotton felt, and surfaces of the activated carbon fibers have a large number of micro-pores with pore sizes less than 2 nm, the micro-pores accounting for a proportion of 5% to 95%.

As an improvement, a particle size of the zeolite particles ranges from 50 nm to 1 mm, preferably between 50 nm and 500 μm, and more preferably between 100 nm and 100 μm. The zeolite particles may be fine powder, particles, or zeolite particles after secondary molding.

As an improvement, the activated carbon cotton felt accounts for 5% to 90% by mass, preferably 10% to 90% by mass, of the porous composite sound-absorbing material, the zeolite particles account for 1% to 85% by mass, preferably 20% to 60% by mass, of the porous composite sound-absorbing material, and the adhesive accounts for 1% to 30% by mass, preferably 5% to 20% by mass, of the porous composite sound-absorbing material.

As an improvement, the adhesive is one or more of an acrylic adhesive, a styrene butadiene adhesive, a polyurethane adhesive, an epoxy adhesive, and a silicone adhesive. The acrylic adhesive may be selected from a methyl acrylate adhesive, an ethyl acrylate adhesive, a butyl acrylate adhesive, an iso-octyl acrylate adhesive, a methyl methacrylate adhesive, an ethyl methacrylate adhesive, or a combination thereof. The styrene butadiene adhesive may be selected from high-temperature emulsion-polymerized styrene butadiene rubber, low-temperature emulsion-polymerized styrene butadiene rubber, or a combination thereof. The polyurethane adhesive may be selected from a polyisocyanate adhesive, an isocyanate group-containing polyurethane adhesive, a hydroxyl-containing polyurethane adhesive, a polyurethane resin adhesive, or a combination thereof. The epoxy adhesive may be a cold-setting adhesive, a thermosetting adhesive or a light curing adhesive. The silicone adhesive is an adhesive based on silicone resin or an adhesive based on silicone rubber.

As an improvement, the dispersing auxiliary agent used in the present disclosure may be one or more of a cationic surfactant, an anionic surfactant, a zwitterionic surfactant, and a nonionic surfactant. Preferably, the cationic surfactant is a quaternary ammonium salt surfactant, which is, for example, but not limited to, octadecyl trimethyl ammonium chloride, hexadecyl trimethyl ammonium chloride, cetyl trimethyl ammonium bromide, or the like. Preferably, the anionic surfactant is a sulfonate surfactant or a sulfate surfactant. The sulfonate surfactant is, for example, but not limited to, sodium dodecyl benzene sulfonate, or the like. The sulfate surfactant is, for example, but not limited to, sodium lauryl sulfate, or the like. The zwitterionic surfactant is, for example, but not limited to, dodecyl aminopropionic acid, hexadecyl dicarboxybetaine, octadecyl dicarboxybetaine, octadecyl hydroxypropyl sulfobetaine, dodecyl sulfobetaine, or the like. The nonionic surfactant is, for example, but not limited to, glyceryl monostearate, sorbitan laurate, sorbitan palmitate, sorbitan stearate, sorbitan tristearate, sorbitan oleate, sorbitan trioleate, or the like.

According to a second aspect of the present disclosure, a method for preparing a porous composite sound-absorbing material mentioned above. The method comprises following steps:

S1: surface treatment of activated carbon cotton felt surface-treating the activated carbon cotton felt to improve sound absorption performance and increase wettability with a sound-absorbing stock solution;

S2: preparation of the sound-absorbing stock solution blending the zeolite particles, the adhesive, a dispersing auxiliary agent, a foaming agent, and a dispersant to obtain the sound-absorbing stock solution;

S3: impregnation impregnating the activated carbon cotton felt treated in step S1 with the sound-absorbing stock solution obtained in step S2 to obtain a zeolite-activated carbon cotton felt composite material;

S4: setting quick-freezing the zeolite-activated carbon cotton felt composite material obtained in step S3 of impregnation, so as to set the zeolite-activated carbon cotton felt composite material;

S5: removal of the dispersant removing, by freeze drying, the dispersant contained in the zeolite-activated carbon cotton felt composite material set in step S4;

S6: curing baking the zeolite-activated carbon cotton felt composite material, from which the dispersant is removed in step S5, under a condition that the adhesive is curable, so as to cure the adhesive contained in the zeolite-activated carbon cotton felt composite material;

S7: cleaning ultrasonically cleaning the zeolite-activated carbon cotton felt composite material by water several times to remove residual dispersing auxiliary agent, foaming agent and unbonded zeolite particles; and S8: drying drying moisture to obtain the porous composite sound-absorbing material.

As an improvement, when the porous composite sound-absorbing material according to the present disclosure is applied to a speaker, preferably, the activated carbon cotton felt is cut according to a shape of a rear cavity of the speaker prior to step S1 of surface treatment.

As an improvement, the activated carbon cotton felt is surface-treated in step S1 in one or more manners selected from plasma treatment, corona treatment, oxidation treatment, reduction treatment, acid treatment, alkali treatment, surfactant solution soaking, and solvent soaking.

As an improvement, the activated carbon cotton felt is surface-treated by oxidation treatment. As an improvement, oxidation treatment is carried out by baking. For example, an air dry oven may be used for baking, a baking temperature generally ranges from 100° C. to 300° C., and baking time generally ranges from 0.5 h to 5 h.

As an improvement, prior to surface treatment, the activated carbon cotton felt may be washed up with a solvent first. For example, the activated carbon cotton felt may be soaked in the solvent and washed up. Soaking time generally ranges from 1 h to 24 h. The solvent is preferably a low-boiling-point organic solvent miscible with water. The organic solvent may be one or more of methanol, ethanol, acetone, tetrahydrofuran, and the like. After the soaking in the solvent, the activated carbon cotton felt may be dried to remove the solvent, to obtain dried activated carbon cotton felt.

According to the method of the present disclosure, definitions of the zeolite particles, the adhesive, and the dispersing auxiliary agent used in the step S2 of preparation of the stock solution are the same as those in the porous composite sound-absorbing material of the present disclosure. The foaming agent used in step S2 may be one or more of a physically volatile foaming agent, a thermal decomposition foaming agent, an azo compound foaming agent, a bicarbonate foaming agent, and a two-component reactive foaming agent. The dispersant used in step S2 is preferably water.

As an improvement, the physically volatile foaming agent applicable to the present disclosure is, for example, but not limited to, a low-boiling-point organic solvent miscible with water. The organic solvent may be one or more of methanol, ethanol, acetone, tetrahydrofuran, and the like.

As an improvement, the thermal decomposition foaming agent applicable to the present disclosure is, for example, but not limited to, a persulfide foaming agent, an azo compound foaming agent, a bicarbonate foaming agent, or the like.

As an improvement, such persulfides may be one or more of potassium persulfate, ammonium persulfate, and the like. Such azo compounds may be one or more of azodicarbonamide, azodiisobutyronitrile, and the like. Such bicarbonate may be one or more of sodium bicarbonate, potassium bicarbonate, and the like.

As an improvement, the two-component reactive foaming agent applicable to the present disclosure may be, for example, but is not limited to, one or more of carbonate+hydrochloric acid, bicarbonate+hydrochloric acid, and the like.

As an improvement, carbonate may be, but is not limited to, one or more of sodium carbonate, potassium carbonate, calcium carbonate, barium carbonate, and the like. Bicarbonate may be, but is not limited to, one or more of sodium bicarbonate, potassium bicarbonate, calcium bicarbonate, barium bicarbonate, and the like.

As an improvement, in step S2, 100 parts of the zeolite particles, 1 to 200 parts of the adhesive, 1 to 50 parts of the dispersing auxiliary agent, 1 to 50 parts of the foaming agent, and 50 to 9900 parts of the dispersant are blended to obtain the sound-absorbing stock solution. As an improvement, in step S2, 100 parts of the zeolite particles, 5 to 20 parts of the adhesive, 3 to 40 parts of the dispersing auxiliary agent, 7 to 40 parts of the foaming agent, and 135 to 1800 parts of the dispersant are blended to obtain the sound-absorbing stock solution.

As an improvement, in step S3 of impregnation, impregnation may be implemented using any method in the art, provided that the activated carbon cotton felt can be completely soaked by the sound-absorbing stock solution. For example, the surface-treated activated carbon cotton felt may be placed in the sound-absorbing stock solution and soaked for 1 h to 24 h, and impregnation time can be shortened to 1 min to 60 min by accelerating the soaking by means of ultrasound or vacuum extraction.

As an improvement, prior to the molding, excess sound-absorbing stock solution on the surface of zeolite-activated carbon cotton felt obtained in step S3 is removed first. For example, the excess sound-absorbing stock solution on the surface may be quickly wiped off by light wiping.

As an improvement, in step S4 of setting, the zeolite-activated carbon cotton felt composite material obtained in step S3 of impregnation can be placed in a low-temperature environment and quickly frozen by using any quick freezing technology in the art, either by a refrigeration device or a refrigerant.

As an improvement, in step S5 of removal of the dispersant, freeze drying may be carried out using a freeze dryer. Freezing temperature and time are not specifically limited, provided that the dispersant, for example, water, in the zeolite-activated carbon cotton felt composite material can be completely removed.

As an improvement, generally, a curing condition used in step S6 of curing, that is, baking time and temperature depend on a specific adhesive used, is not specifically limited, provided that the adhesive can be completely cured and the zeolite particles are firmly bonded to the fiber surface of the activated carbon cotton felt.

As an improvement, in step S7 of cleaning, cleaning may be carried out using any method known in the art, preferably by an ultrasonic cleaner. Cleaning number and time are not limited, provided that residual dispersing auxiliary agent and foaming agent and unbonded zeolite particles can be removed. Preferably, the water for cleaning is deionized water.

As an improvement, in step S8 of drying, the moisture may be dried using any method known in the art, for example, by using a drying over. A drying temperature generally ranges from 80° C. to 150° C., and drying time generally ranges from 0.5 h to 2 h.

As an improvement, the foaming agent is one or more of a physically volatile foaming agent, a thermal decomposition foaming agent, and a two-component reactive foaming agent.

As an improvement, the dispersing auxiliary agent is one or more of a cationic surfactant, an anionic surfactant, a zwitterionic surfactant, and a nonionic surfactant.

According to a third aspect of the present disclosure, the present disclosure provides a speaker. The speaker includes a rear cavity. The rear cavity includes the porous composite sound-absorbing material mentioned above.

In the present disclosure, the activated carbon cotton felt is used as a framework material. Compared with conventional materials such as sound-absorbing cotton and sound-absorbing fibers, the activated carbon cotton felt has more excellent sound absorption performance due to existence of a large number of micro-pore structures. Moreover, even if a small amount of zeolite materials is used, the sound absorption performance is also very excellent, so the cost performance is higher.

In addition, during the preparation of the porous composite sound-absorbing material according to the present disclosure, quick-freezing setting and freeze drying technologies are used, so that the zeolite particles can be uniformly distributed in the activated carbon cotton felt, which solves the problems of uneven distribution of zeolite and a limited load depth caused by gravity or viscosity of the sound-absorbing stock solution in a conventional process. Therefore, the sound absorption performance of the composite material can be significantly improved, and the problem that granular materials such as zeolite and activated carbon are not suitable for a complex speaker cavity is also solved at the same time.

After the rear cavity of the speaker is filled with the porous composite sound-absorbing material according to the present disclosure, low-frequency performance of the speaker can be greatly improved and the performance is more stable. Acoustic speakers have been applied to fields of mobile phones, earphones, computers, automobiles, TVs, audio, and so on. Therefore, the present disclosure has a broad application prospect.

These and other objectives, aspects, and advantages of the present disclosure will become obvious according to the following descriptions of the present disclosure and with reference to the accompanying drawings.

1: activated carbon fiber of activated carbon cotton felt in the porous composite sound-absorbing material according to the present disclosure; 2: zeolite particle.

Figure 2:
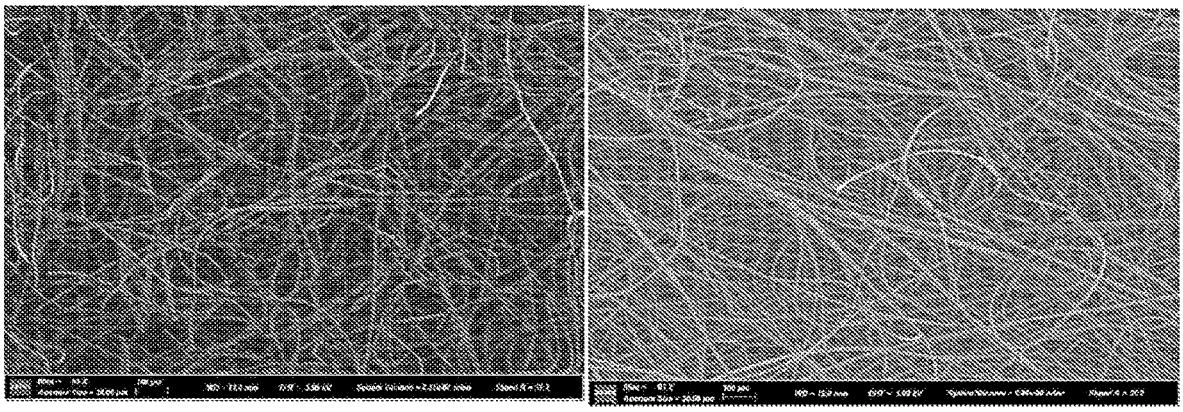

FIG. 2 shows a scanning electron microscope (SEM) image of activated carbon cotton felt after oxidation treatment, in which the left panel shows the front, and the right panel shows the side.

Figure 3:
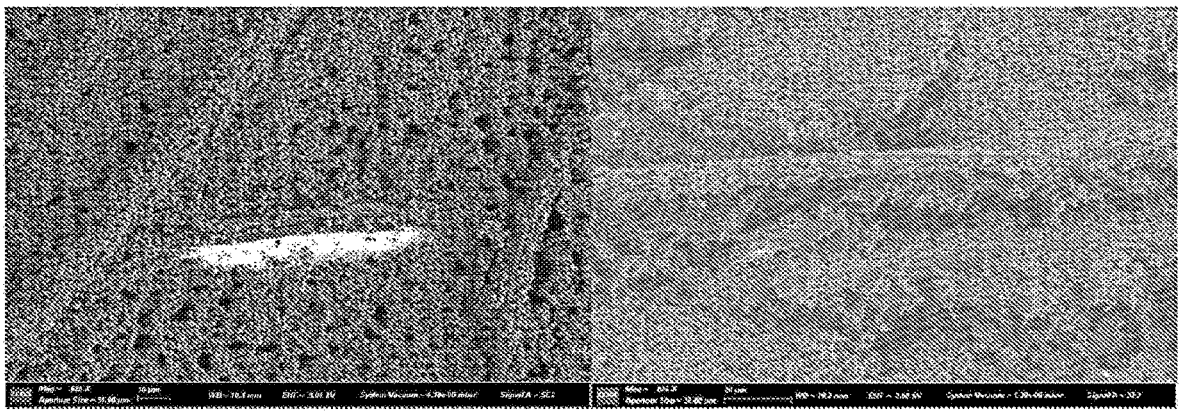

FIG. 3 shows an SEM image of a porous composite sound-absorbing material prepared according to Example 1 of the present disclosure, in which the left panel shows the front, and the right panel shows the side.

DESCRIPTION OF EMBODIMENTS

Figure 1:
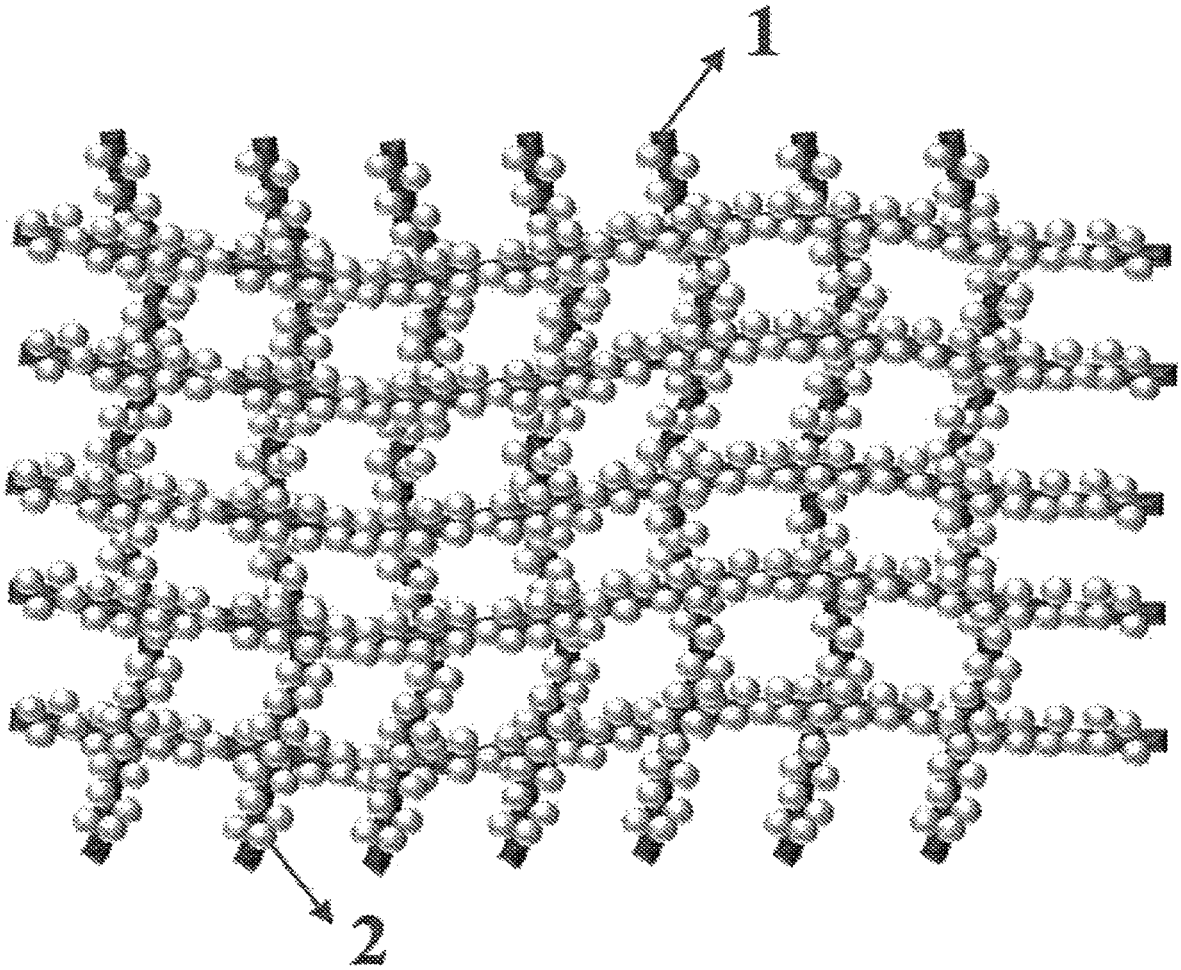
FIG. 1 is a schematic structural diagram of a porous composite sound-absorbing material according to the present disclosure, in which the following reference signs are used.

Activated carbon cotton felt is used as a framework material, and zeolite particles are bonded to a fiber surface of the activated carbon cotton felt by means of an adhesive and undergo quick-freezing setting, freeze drying, and high-temperature treatment. The present disclosure prepares a new porous composite sound-absorbing material, whose schematic structural diagram is shown in FIG. 1.

The activated carbon cotton felt used in the present disclosure has a large number of micro-pores, whose sound absorption performance is obviously better than that of sound-absorbing cotton and sound-absorbing fibers with only macro-pore structures. Moreover, after modification of zeolite with better sound absorption performance and in combination with the quick-freezing setting technology that can significantly improve uniformity of distribution of zeolite, the present disclosure greatly reduces the costs and solves the technical problem of inconvenient use of granular materials such as zeolite. The porous composite sound-absorbing material according to the present disclosure also further improves the sound absorption performance of the activated carbon cotton felt, so that low-frequency performance thereof can be significantly improved after a rear cavity of a speaker is filled with the porous composite sound-absorbing material according to the present disclosure.

Further descriptions are provided below through embodiments. It should be understood that specific embodiments described herein are intended only to interpret the present disclosure but not to limit the present disclosure.

PREPARATION EXAMPLE

Example 1

Activated carbon cotton felt with macro-pores having pore sizes ranging from 1 μm to 1000 μm and micro-pores having pore sizes below 2 nm was used. A specific surface area of the activated carbon cotton felt was 1300 $m^2/g$, and the micro-pores accounted for a proportion of 80%.

The activated carbon cotton felt was cut according to a shape of a rear cavity of a speaker. By mass, there were 30 parts of the activated carbon cotton felt after cutting, which were soaked in ethanol for 12 h and then baked in an air dry oven at 110° C. for 2 h to remove the ethanol.

The activated carbon cotton felt was baked in the air dry oven at 200° C. for 2 h and underwent oxidization treatment. The front and the side of the activated carbon cotton felt were scanned using an SEM respectively, to obtain an SEM image shown in FIG. 2, in which the left panel shows the front, and the right panel shows the side. Refer to Table 1 for acoustic performance data thereof.

By mass, 100 parts of zeolite particles having pore sizes ranging from 0.2 μm to 20 μm, 20 parts of a styrene butadiene adhesive, 10 parts of sodium lauryl sulfate, 40 parts of potassium persulfate, and 1800 parts of water were evenly mixed by a magnetic stirrer to obtain the sound-absorbing stock solution, ready for use.

The activated carbon cotton felt after oxidization treatment was placed in the sound-absorbing stock solution to undergo ultrasound for 1 h, the soaked activated carbon cotton felt was then taken out, excess sound-absorbing stock solution on its surface was gently and quickly wiped off using filter paper, and then the activated carbon cotton felt was quickly frozen and set through a low-temperature environment (either by using a refrigeration device or a refrigerant).

After being quickly frozen and set, the activated carbon cotton felt was frozen and dried using a freeze dryer, so as to completely remove moisture in the material.

After being frozen and dried, the activated carbon cotton felt was baked for 2 h in the oven at a temperature of 110° C. to cause the styrene butadiene adhesive to be completely cured.

The activated carbon cotton felt was cleaned 5 times with deionized water by using an ultrasonic cleaner, which was cleaned for 10 min each time, to remove residual foaming agent and surfactant and unbonded zeolite particles, and was baked for 1 h in the oven at the temperature of 110° C. to obtain a blocky porous composite sound-absorbing material.

The front and the side of the obtained porous composite sound-absorbing material were scanned using an SEM respectively, to obtain an SEM image shown in FIG. 3, from which it can be obviously seen that the zeolite particles had been firmly bonded to a fiber surface of the activated carbon cotton felt. Refer to Table 1 for acoustic performance data thereof.

Example 2

The activated carbon cotton felt used in this embodiment was completely the same as that in Example 1.

The activated carbon cotton felt was cut according to a shape of a rear cavity of a speaker. By mass, there were 30 parts of the activated carbon cotton felt after cutting, which were soaked in ethanol for 12 h and then baked in an oven at 110° C. for 2 h to remove the ethanol.

The activated carbon cotton felt was baked in the air dry oven at 200° C. for 2 h and underwent oxidization treatment.

By mass, 100 parts of zeolite particles having pore sizes ranging from 0.2 μm to 20 μm, 10 parts of a silicone adhesive, 15 parts of sodium dodecyl benzene sulfonate, 20 parts of ammonium persulfate, and 550 parts of water were evenly mixed by a magnetic stirrer to obtain the sound-absorbing stock solution, ready for use.

The activated carbon cotton felt after oxidization treatment was placed in the sound-absorbing stock solution to undergo ultrasound for 1 h, the soaked activated carbon cotton felt was then taken out, excess sound-absorbing stock solution on its surface was gently and quickly wiped off using filter paper, and then the activated carbon cotton felt was quickly frozen and set through a low-temperature environment (either by using a refrigeration device or a refrigerant).

After being quickly frozen and set, the activated carbon cotton felt was frozen and dried using a freeze dryer, so as to completely remove moisture in the material.

After being frozen and dried, the activated carbon cotton felt was baked for 2 h in the oven at a temperature of 110° C. to cause the silicone adhesive to be completely cured.

The activated carbon cotton felt was cleaned 5 times with deionized water by using an ultrasonic cleaner, which was cleaned for 10 min each time, to remove residual foaming agent and surfactant and unbonded zeolite particles, and was baked for 1 h in the oven at the temperature of 110° C. to obtain a blocky porous composite sound-absorbing material.

The front and the side of the obtained porous composite sound-absorbing material were scanned using an SEM respectively, to obtain an SEM image (the SEM image was not shown) basically the same as the SEM image of the porous composite sound-absorbing material in Example 1, from which it can be obviously seen that the zeolite particles had been firmly bonded to a fiber surface of the activated carbon cotton felt. Refer to Table 1 for details of acoustic performance data thereof.

Example 3

The activated carbon cotton felt used in this embodiment was completely the same as that in Example 1.

The activated carbon cotton felt was cut according to a shape of a rear cavity of a speaker. By mass, there were 30 parts of the activated carbon cotton felt after cutting, which were soaked in ethanol for 12 h and then baked in an air dry oven at 110° C. for 2 h to remove the ethanol.

The activated carbon cotton felt was baked in the air dry oven at 200° C. for 2 h and underwent oxidization treatment.

By mass, 100 parts of zeolite particles having pore sizes ranging from 0.2 μm to 20 μm, 15 parts of an acrylic adhesive, 3 parts of sodium dodecyl benzene sulfonate, 7 parts of sodium bicarbonate, and 135 parts of water were evenly mixed by a magnetic stirrer to obtain the sound-absorbing stock solution, ready for use.

The activated carbon cotton felt after oxidization treatment was placed in the sound-absorbing stock solution to undergo ultrasound for 1 h, the soaked activated carbon cotton felt was then taken out, excess sound-absorbing stock solution on its surface was gently and quickly wiped off using filter paper, and then the activated carbon cotton felt was quickly frozen and set through a low-temperature environment (either by using a refrigeration device or a refrigerant).

After being quickly frozen and set, the activated carbon cotton felt was frozen and dried using a freeze dryer, so as to completely remove moisture in the material.

After being frozen and dried, the activated carbon cotton felt was baked for 2 h in the oven at a temperature of 110° C. to cause the styrene butadiene adhesive to be completely cured.

The activated carbon cotton felt was cleaned 5 times with deionized water by using an ultrasonic cleaner, which was cleaned for 10 min each time, to remove residual foaming agent and surfactant and unbonded zeolite particles, and was baked for 1 h in the oven at the temperature of 110° C. to obtain a blocky porous composite sound-absorbing material.

The front and the side of the obtained porous composite sound-absorbing material were scanned using an SEM respectively, to obtain an SEM image (the SEM image was not shown) is basically the same as the SEM image of the porous composite sound-absorbing material in Example 1, from which it can be obviously seen that the zeolite particles had been firmly bonded to a fiber surface of the activated carbon cotton felt. Refer to Table 1 for details of acoustic performance data thereof.

Measurement of Acoustic Performance

According to a method for measuring a resonant frequency of a speaker, the porous composite sound-absorbing materials prepared in Example 1, Example 2, and Example 3 were respectively placed in a suitable tool, values of decline in a resonant frequency (F0) thereof were tested using an impedance analyzer, and dropping and breakage of the porous composite sound-absorbing materials were tested through a dropping test. F0 decline denotes a degree to which the resonant frequency moves to a low frequency. Generally, the greater the value of F0 decline, the better the low-frequency performance of the speaker.

A volume of a tooling rear cavity of the speaker used in measurement of acoustic performance was 0.4 cubic centimeter (0.4 cc for short), and specific test results were shown in Table 1.

TABLE 1

Test results of acoustic performance in examples

| Sample | F0 (Hz) | F0 decline (Hz) | Dropping and breakage |
|---|---|---|---|
| The rear cavity was not filled with any sound-absorbing material | 1039 | — | — |
| The rear cavity was filled with sound-absorbing foam | 994 | 45 | No breakage, and no powder dropping |
| The rear cavity was filled with sound-absorbing fibers | 996 | 43 | No breakage, and no powder dropping |
| The rear cavity was filled with treated activated carbon cotton felt (a framework material with a large number of micro-pores in an example) | 925 | 114 | No breakage, and no powder dropping |
| The rear cavity was filled with Bass powder | 801 | 238 | No breakage, and no powder dropping |
| The rear cavity was filled with the porous composite sound-absorbing material in Example 1 | 877 | 162 | No breakage, and slight powder dropping |
| The rear cavity was filled with the porous composite sound-absorbing material in Example 2 | 834 | 205 | No breakage, and no powder dropping |
| The rear cavity was filled with the porous composite sound-absorbing material in Example 3 | 768 | 271 | No breakage, and no powder dropping |

It can be known according to the results in Table 1 that the activated carbon cotton felt (framework material) in the disclosure had more excellent sound absorption performance than the conventional framework materials (the sound-absorbing foam and the sound-absorbing fibers) due to presence of micro-pore structures. After the rear cavity of the tooling was filled with the porous composite sound-absorbing material according to the present disclosure, the F0 decline of the speaker was no less than 160 Hz. After the rear cavity was filled with the porous composite sound-absorbing material according to Example 3, the F0 decline of the speaker was 271 Hz, and its performance was significantly better than that of the activated carbon cotton felt and Bass particles (current sound-absorbing materials with the best speaker commercial use effect), indicating that the low-frequency performance was significantly improved. Meanwhile, the price of the material of the present disclosure was greatly reduced compared with Bass, and thus has extremely high cost performance. In addition, slight powder dropping occurred in the speaker made of the porous composite sound-absorbing material in Example 1, while no powder dropping occurred in the speakers made of the porous composite sound-absorbing material in Example 2 and the porous composite sound-absorbing material in Example 3.

The objectives, technical solutions, and beneficial effects of the present disclosure are described in detail above. It should be understood that the above descriptions are merely embodiments and specific examples of the present disclosure, and are not intended to limit the protection scope of the present disclosure. Any modification, equivalent replacement, improvement, and the like made within the spirit and principle of the present disclosure shall fall within the protection scope of the present disclosure.

What is claimed is:

1. A porous composite sound-absorbing material, comprising activated carbon cotton felt, zeolite particles, and an adhesive;

wherein the activated carbon cotton felt serves as a framework material, and the zeolite particles are bonded to a fiber surface of the activated carbon cotton felt by means of the adhesive.

2. The porous composite sound-absorbing material as described in claim 1, wherein macro-pores with pore sizes ranging from 1 μm to 1000 μm exist among activated carbon fibers of the activated carbon cotton felt, and surfaces of the activated carbon fibers have a large number of micro-pores with pore sizes less than 2 nm, the micro-pores accounting for a proportion of 5% to 95%.

3. The porous composite sound-absorbing material as described in claim 1, wherein a particle size of the zeolite particles ranges from 50 nm to 1 mm.

4. The porous composite sound-absorbing material as described in claim 1, wherein, the activated carbon cotton felt accounts for 5% to 90% by mass of the porous composite sound-absorbing material, the zeolite particles account for 1% to 85% by mass of the porous composite sound-absorbing material, and the adhesive accounts for 1% to 30% by mass of the porous composite sound-absorbing material.

5. The porous composite sound-absorbing material as described in claim 1, wherein the adhesive is one or more of an acrylic adhesive, a styrene butadiene adhesive, a polyurethane adhesive, an epoxy adhesive, and a silicone adhesive.

6. A method for preparing a porous composite sound-absorbing material as described in claim 1, the method comprising following steps:

S1: surface treatment of activated carbon cotton felt surface-treating the activated carbon cotton felt to improve sound absorption performance and increase wettability with a sound-absorbing stock solution;

S2: preparation of the sound-absorbing stock solution blending the zeolite particles, the adhesive, a dispersing auxiliary agent, a foaming agent, and a dispersant to obtain the sound-absorbing stock solution;

S3: impregnation impregnating the activated carbon cotton felt treated in step S1 with the sound-absorbing stock solution obtained in step S2 to obtain a zeolite-activated carbon cotton felt composite material;

S4: setting quick-freezing the zeolite-activated carbon cotton felt composite material obtained in step S3 of impregnation, so as to set the zeolite-activated carbon cotton felt composite material;

S5: removal of the dispersant removing, by freeze drying, the dispersant contained in the zeolite-activated carbon cotton felt composite material set in step S4;

S6: curing baking the zeolite-activated carbon cotton felt composite material, from which the dispersant is removed in step S5, under a condition that the adhesive is curable, so as to cure the adhesive contained in the zeolite-activated carbon cotton felt composite material;

S7: cleaning ultrasonically cleaning the zeolite-activated carbon cotton felt composite material by water several times to remove residual dispersing auxiliary agent, foaming agent and unbonded zeolite particles; and S8: drying drying moisture to obtain the porous composite sound-absorbing material.

7. The method as described in claim 6, wherein the activated carbon cotton felt is surface-treated in step S1 in one or more manners selected from plasma treatment, corona treatment, oxidation treatment, reduction treatment, acid treatment, alkali treatment, surfactant solution soaking, and solvent soaking.

8. The method as described in claim 6, wherein, in step S2, 100 parts of the zeolite particles, 1 to 200 parts of the adhesive, 1 to 50 parts of the dispersing auxiliary agent, 1 to 50 parts of the foaming agent, and 50 to 9900 parts of the dispersant are blended to obtain the sound-absorbing stock solution.

9. The method as described in claim 6, wherein the foaming agent is one or more of a physically volatile foaming agent, a thermal decomposition foaming agent, and a two-component reactive foaming agent.

10. The method as described in claim 6, wherein the dispersing auxiliary agent is one or more of a cationic surfactant, an anionic surfactant, a zwitterionic surfactant, and a nonionic surfactant.

11. A speaker, comprising a rear cavity, wherein the rear cavity comprises a porous composite sound-absorbing material, wherein the porous composite sound-absorbing material comprises activated carbon cotton felt, zeolite particles, and an adhesive;

wherein the activated carbon cotton felt serves as a framework material, and the zeolite particles are bonded to a fiber surface of the activated carbon cotton felt by means of the adhesive.

* * * * *